US008511234B2

(12) United States Patent
Nelson

(10) Patent No.: US 8,511,234 B2
(45) Date of Patent: Aug. 20, 2013

(54) SNOW SLED TOWING DEVICE

(76) Inventor: Leonard Nelson, Calgary (CA)

( * ) Notice: Subject to any disclaimer, the term of this patent is extended or adjusted under 35 U.S.C. 154(b) by 141 days.

(21) Appl. No.: 13/155,806

(22) Filed: Jun. 8, 2011

(65) Prior Publication Data

US 2012/0312187 A1 Dec. 13, 2012

(51) Int. Cl.
*B61B 11/00* (2006.01)
*B61B 7/00* (2006.01)

(52) U.S. Cl.
USPC ..... 104/173.2; 104/112

(58) Field of Classification Search
USPC ..... 104/112, 115, 165, 162, 173.1, 173.2, 104/200, 202
See application file for complete search history.

(56) References Cited

U.S. PATENT DOCUMENTS 5,020,443 A 6/1991 Gauthier
5,415,106 A 5/1995 Groskreutz et al.
5,673,625 A 10/1997 Dahlstrom
6,145,679 A 11/2000 Walters
6,152,044 A 11/2000 Bouvier
6,295,936 B1 * 10/2001 Dahlstrom ..... 104/173.2
6,360,669 B1 * 3/2002 Albrich ..... 104/93
2003/0047107 A1 3/2003 Thomas
2004/0074415 A1 4/2004 Aaltonen et al.
2004/0231957 A1 11/2004 Multerer
2008/0027599 A1 1/2008 Logan et al.

* cited by examiner

*Primary Examiner* — R. J. McCarry, Jr.
(74) *Attorney, Agent, or Firm* — Maxey Law Offices, PLLC; Stephen Lewellyn

(57) ABSTRACT

A device and system for towing snow sleds either alone or with one or more riders along the surface of a snow cover slope to a higher position includes a tow cable extending continuously along a closed loop path between the starting position and the arriving position along the slope. Tow cable pulleys are located at the starting position and the arriving position upon which the cable is supported and driven. A drive motor is operatively connected to one of the cable pulleys and operating to rotatingly drive the pulley to drive the cable through the closed loop path. One or more tow hooks are connected in series at spaced intervals to the tow cable for conjoint movement therewith. Additional embodiments are disclosed.

10 Claims, 8 Drawing Sheets

SNOW SLED TOWING DEVICE

FIELD OF THE INVENTION

The present invention relates generally to snow sledding, and more particularly, relating to the pulling of snow sleds and riders up a snow slope by a tow rope.

BACKGROUND OF THE INVENTION

It is known at ski slopes to install a cableway devices or other towing system in which persons with their skis are towed along the surface of the slope to a higher location on the slope. While the devices and systems heretofore meet their respective objects and requirements. A need remains for a new towing device and system particularly suited for towing snow sleds either alone or with accompanying riders along the surface of a slope.

SUMMARY OF THE INVENTION

Embodiments of the present invention addresses this need by providing a snow sled towing device and system for towing a snow sled along the surface of a snow covered slope.

Embodiments of the present invention also provide a snow sled towing device and system that is easily operated and maintained.

Embodiments of the present invention also provide a snow sled towing device and system including tow hooks that prevent snagging and injury to persons.

Embodiments of the present invention also provide a snow sled towing device and system including multiple snow sled towing stations arranged side-by-side along a slope that are each independently operated.

To achieve these and other advantages, in general, in one aspect, a snow sled towing device for towing one or more sleds up a slope from a starting position located towards the bottom of the slope to an arriving position located towards a top of the slope is provided. The device comprising includes a tow cable extending continuously along a closed loop path between the starting position and the arriving position along the slope. Tow cable pulleys are located at the starting position and the arriving position upon which the cable is supported and driven. A drive motor is operatively connected to one of the cable pulleys and operating to rotatingly drive the pulley to drive the cable through the closed loop path. One or more tow hooks are connected in series at spaced intervals to the tow cable for conjoint movement therewith.

In general, in another aspect, a snow sled towing device for towing one or more sleds up a slope from a starting position located towards the bottom of the slope to an arriving position located towards a top of the slope is provided. The device includes a tow cable and a tow cable drum disposed at the arriving position and upon which the tow cable is wound. A drive motor is operatively connected to the tow cable drum and operates to rotationally drive the tow cable drum to wind and unwind the tow cable from the tow cable drum. One or more tow hooks attached to a free end of the tow cable.

In general, in another aspect, a snow sled towing system for simultaneously and independently towing two or more snow sleds up a slope from a starting position located towards the bottom of the slope to an arriving position located towards a top of the slope, the device comprising. The system includes a plurality of tow stations arranged side-by-side along the slope and extending between the starting position and the arriving position. A guard railing is disposed between adjacent tow stations, and each tow station includes a tow cable, a tow cable drum disposed at the arriving position and upon which the tow cable is wound, a drive motor operatively connected to the tow cable drum and operating to rotationally drive the tow cable drum to wind and unwind the tow cable from the tow cable drum, and one or more tow hooks attached to a free end of the tow cable. The drive motors of each tow station are operated independently of one another.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
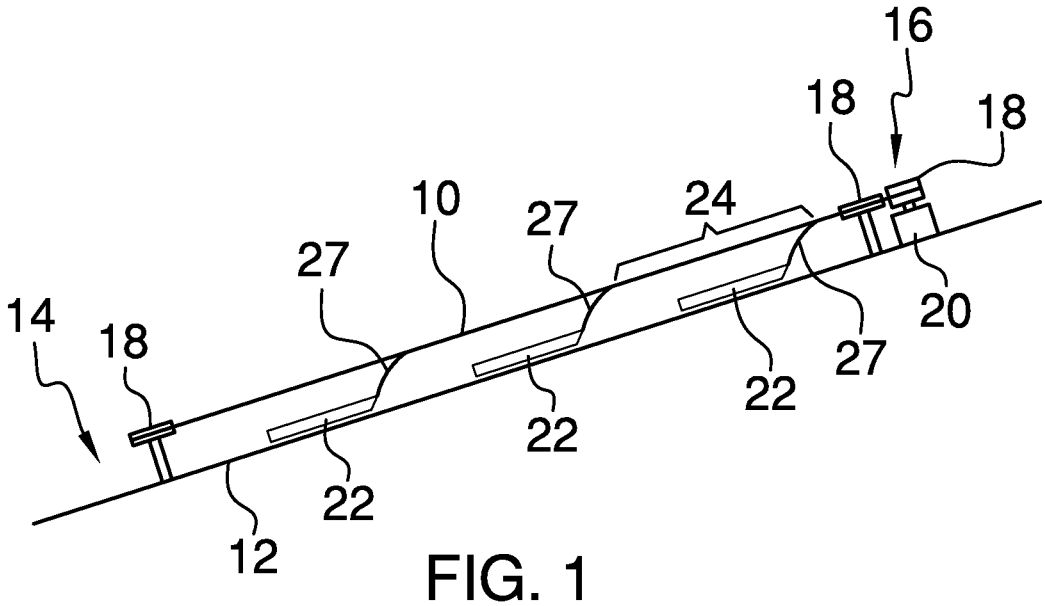
FIG. 1 is a diagrammatic illustration of a snow sled towing device and system in accordance with an embodiment of the present invention.
Figure 2:
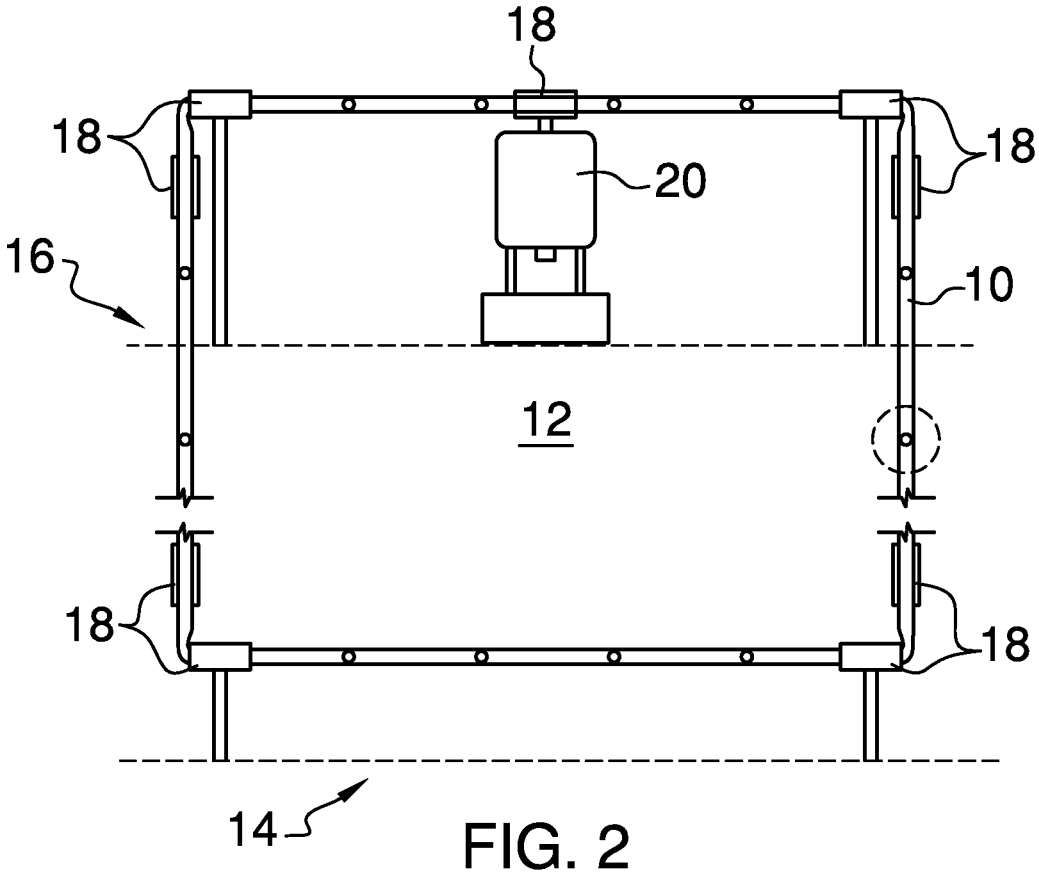
FIG. 2 is a diagrammatic detailed front illustration of a snow sled towing device and system in accordance with an embodiment of the present invention.
Figure 3:
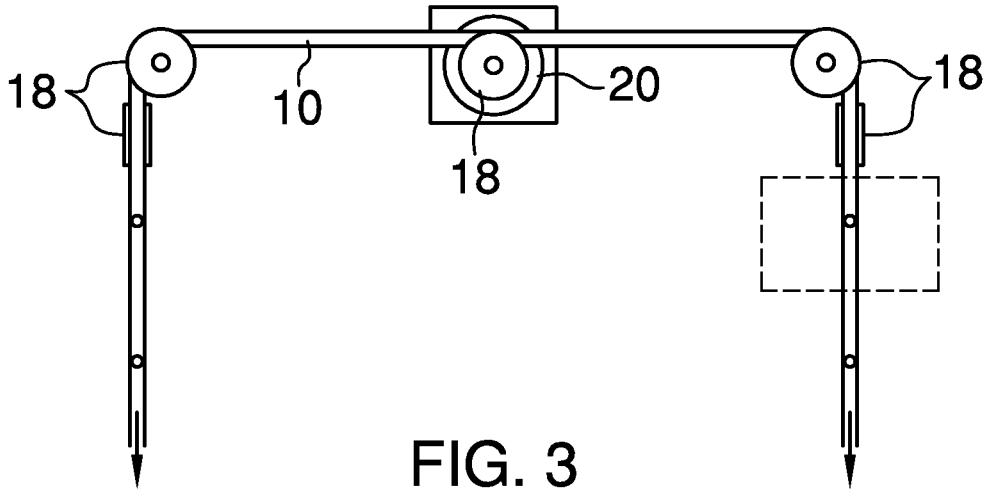
FIG. 3 is a partial diagrammatic top illustration of a snow sled towing device and system in accordance with an embodiment of the present invention.

Referring to FIGS. 1 through 3 of the drawings, an embodiment of the sled towing device includes an endless tow cable 10 extending in a closed loop path along the side of a slope 12 from a starting position 14 disposed at a bottom of the slope and an arriving position 16 disposed at a top of the slope. The tow cable 10 may comprise a steel cable or the like. Alternatively, the tow cable 10 may comprise a nylon rope or the like. A plurality of tow cable pulleys 18 are disposed at the starting position 14 and the arriving position 16 upon which the tow cable is supported and driven through the closed loop path. While not illustrated, additional tow cable pulleys may be disposed along the ascent and descent portions of the closed loop path to further support the tow cable between the starting position 14 and arriving position 16.

A drive motor 20 is operatively connected to a pulley 18 and is operated to rotatingly drive the pulley which in turn drives the tow cable 10 through the closed loop path. In an embodiment, the drive motor 20 may be an electric motor. The electric motor may include an overload protection circuit which operates to shut down the electric motor upon over heating which may be a result of an overloaded tow cable or obstruction of the tow cable from moving through the closed loop path. In an embodiment, the drive motor 20 may be a combustion engine. The combustion engine may include an overload protection device that operates to detect an overloaded tow cable or obstruction of the tow cable from moving through the closed loop path. In embodiments, lift attendants located at the starting position 14 and arriving position 16 will be provided with lift operating controls for operating the drive motor 20. In an example, the lift operating controls may include a safety shut down switch, which when depressed will halt the driving of the tow cable 10 by either stopping the drive motor 20 or operating a clutch to disengage the drive motor from the driven pulley 18. In embodiment, the lift attendants will carry with them wirelessly operated lift operating controls to permit the attendant to control the operation of the lift from any position within the vicinity of the lift.

In embodiment, lift operation sensors may be provided to monitor various aspect of the lift, such as the motion of the tow cable 10, pulleys 18 or a combination of both. In an example, a hall sensor, proximity sensor, acceleration sensor may be fitted to the tow cable 10, one or more pulley 18 or a combination of both to monitor the motion of the operation of the lift and the tow cable. If an anomaly is detected, such as a motion lost in a pulley, the lift may be shut down.

As illustrated in FIG. 1, snow sleds 22 are secured to the tow cable 10 at spaced intervals 24 beginning at the starting position 14 and on the ascending length of the tow cable. As the tow cable 10 is driven through the closed loop path, the snow sleds 22 are pulled up the slope from the starting position 14 to the arriving position 16 where the snow sleds are then unsecured from the tow cable. Snow sleds 22 are secured to the tow cable 10 so as to permit the snow sleds to ride along the slope surface while being pulled by the tow cable. In an embodiment, intervals 24 are about seven-feet to safely permit towing adjacent six-foot sleds. Further, in an embodiment, the tow cable 10 is driven at a height of about two-feet from the slope surface.

It is contemplated that safety fencing would be employed to separate the lift area from the sledding area prevent accidental sledding into the lift area and to prevent injury to sliders.

Figure 4:
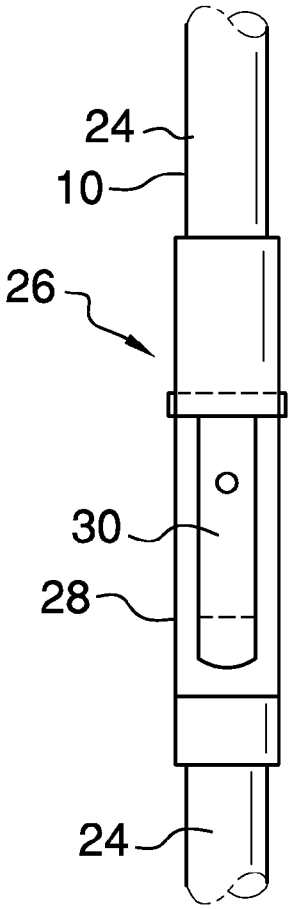
FIG. 4 is a front illustration of a tow hook in accordance with an embodiment of the present invention.
Figure 5:
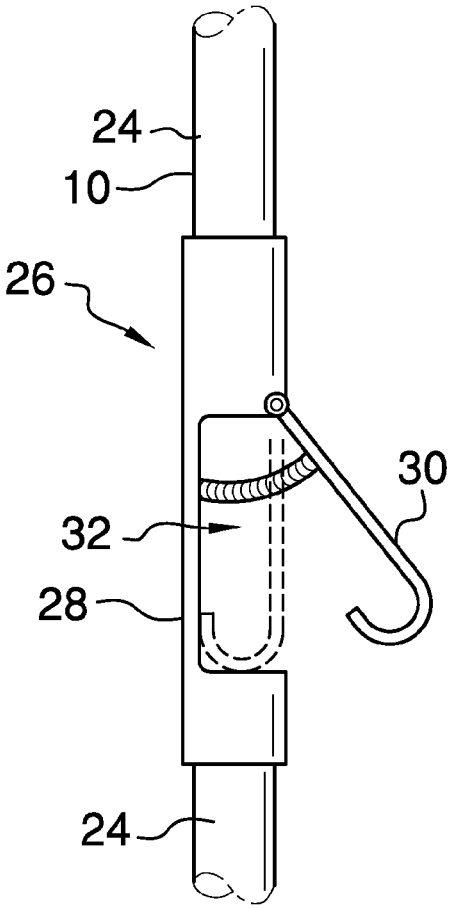
FIG. 5 is a side illustration of the tow hook of FIG. 4.

In FIGS. 4 and 5, there is illustrated one embodiment of a tow hook 26 for securing a snow sled to the tow cable 10 by a tow rope 27 (FIG. 1) attached to the forward end of the snow sled. Tow hook 26 comprises a body 28 and a hook member 30. The hook member 30 is pivotally attached to the body 28 for rotation between a first position where the hook member 30 is disposed within a recess 32 of the body and second position where the hook member is disposed outwardly from the recess. In Body 28 and hook member 30 are configured such that when the hook member is in the first position and disposed within the recess 32, the hook member and body are substantially flush. In this manner, tow hook 26 is prevented from binding with pulleys 18 and the hook member 30 is safely disposed to guard against snagging on an attendant which could result in serious injury to the attendant. In an embodiment, hook member 30 is spring biased into the recess 32.

In an embodiment, and as illustrated in FIGS. 4 and 5, tow cable 10 is comprised of individual interval lengths 24 that are spliced together end-to-end by tow hook 26 to form the continuous tow cable. Each tow hook 26 splices together two interval lengths 24 of the tow cable 10.

Figure 6:
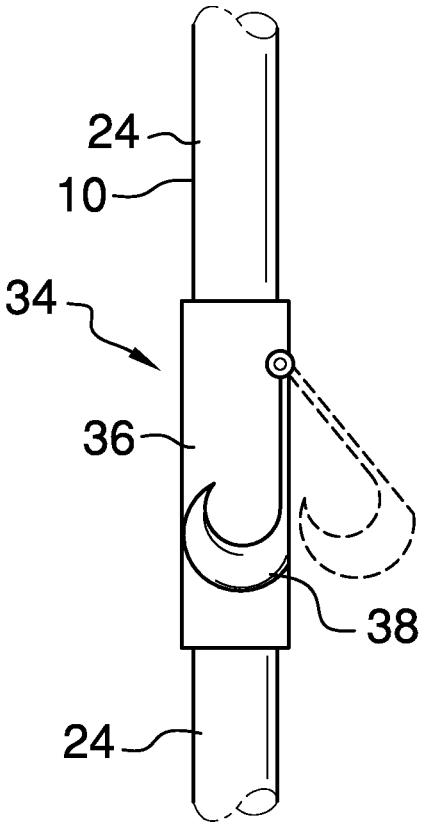
FIG. 6 is a front illustration of a tow hook in accordance with an embodiment of the present invention.
Figure 7:
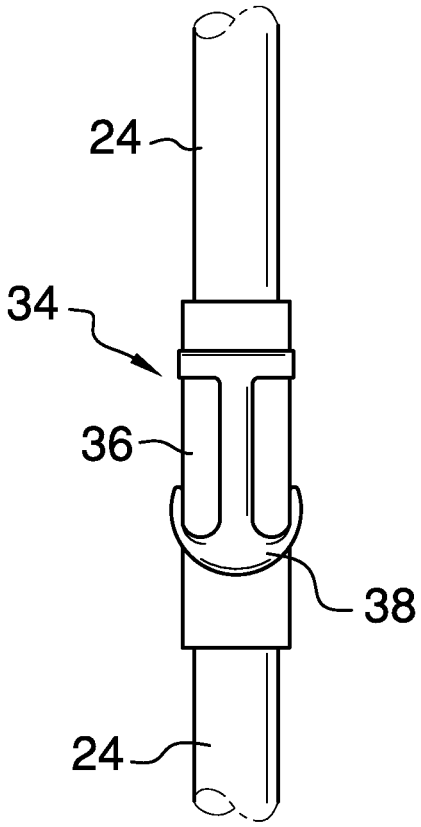
FIG. 7 is a side illustration of the tow hook of FIG. 6.

In FIGS. 6 and 7, an alternative tow hook 34 is illustrated. Tow hook 34 includes body 36 and hook member 38. The hook member 38 is pivotally attached to the body 36 for rotation between a first position where the hook member 38 is disposed substantially flush with the body (when at a tow rope 17 is not secured) and second position where the hook member is disposed outwardly from the body. In Body 36 and hook member 38 are configured such that when the hook member is in the first position the hook member partially wraps around the body. In this manner, tow hook 34 is prevented from binding with pulleys 18 and the hook member 38 is safely disposed to guard against snagging on an attendant which could result in serious injury to the attendant. In an embodiment, hook member 38 is spring biased against the body 36.

As discussed above and similarly here, tow cable 10 may be comprised of individual interval lengths 24 that are spliced together end-to-end by tow hook 34 to form the continuous tow cable. Each tow hook 34 splices together two interval lengths 24 of the tow cable 10. Alternatively, body 36 of tow-hook 34 may be comprised of a sleeve that encircles the tow cable 10.

Figure 8:
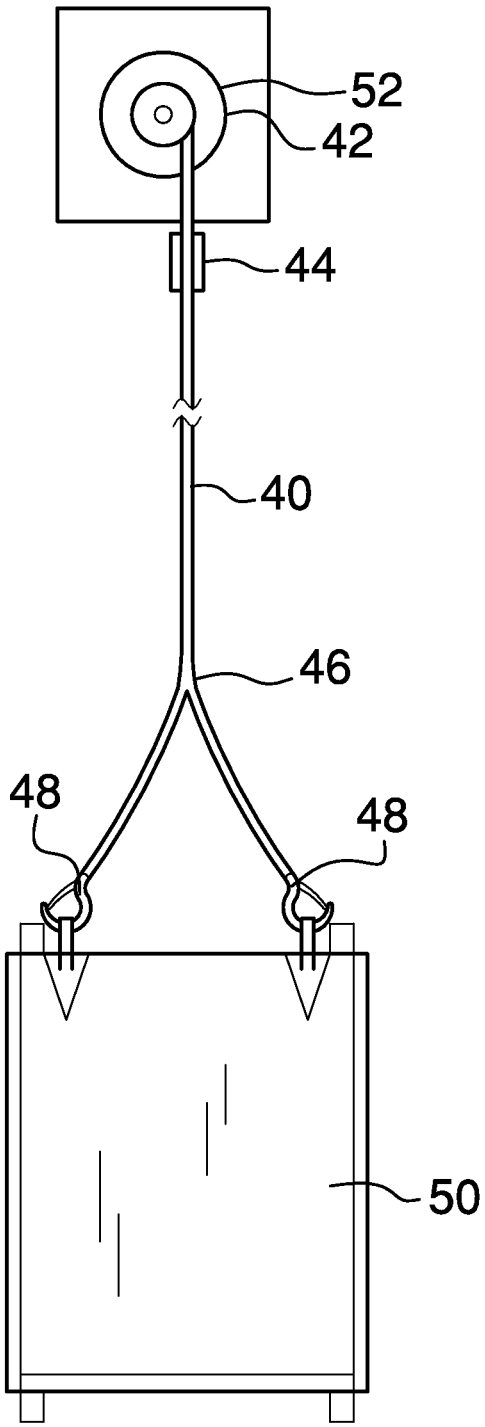
FIG. 8 is a diagrammatic illustration of a snow sled towing device and system in accordance with an embodiment of the present invention.
Figure 9:
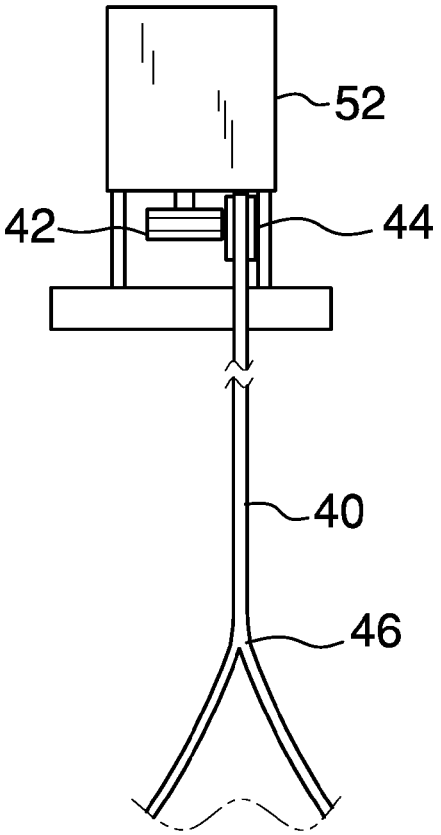
FIG. 9 is a diagrammatic illustration of a snow sled towing device and system in accordance with an embodiment of the present invention.

In FIGS. 8 and 9, there is illustrated an alternative embodiment of the invention comprising a tow cable 40 that is wound upon cable drum 42. A guide pulley 44 may provided to guide tow cable 40 on cable drum 42. The free end 46 of the tow cable 40 is fitted with one or more tow hooks 48 for connection with a snow sled 22 (not shown) or a transport cart 50 as depicted. Further, while two tow hooks 48 are shown connected to a y-portion of the tow cable 40, a single tow hook could be employed. However, the two tow hook arrangement provides for better stability when towing. Tow hooks 48 could simply be spring loaded carbineers or hooks.

A drive motor 52 is operatively connected to the cable drum 42 is operated to rotatingly drive the cable drum to wind and unwind the tow cable 40 from the cable drum to alternately position the free end 46 of the tow cable and/or attached sled between the starting position (not shown) and arriving position (not shown) to tow a sled up the slope.

Similarly as discussed above, drive motor 52 may be an electric motor. The electric motor may include an overload protection circuit which operates to shut down the electric motor upon over heating which may be a result of an overloaded tow cable or obstruction of the tow cable from moving through the closed loop path. In an embodiment, the drive motor 52 may be a combustion engine. The combustion engine may include an overload protection device that operates to detect an overloaded tow cable or obstruction of the tow cable from moving through the closed loop path.

In embodiments, lift attendants located at the starting position and arriving position will be provided with lift operating controls for operating the drive motor 52. In an example, the lift operating controls may include a safety shut down switch, which when depressed will halt the driving of the tow cable 40 by either stopping the drive motor 52 or operating a clutch to disengage the drive motor from the cable drum 42. In embodiment, the lift attendants will carry with them wirelessly operated lift operating controls to permit the attendant to control the operation of the lift from any position within the vicinity of the lift.

Figure 10:
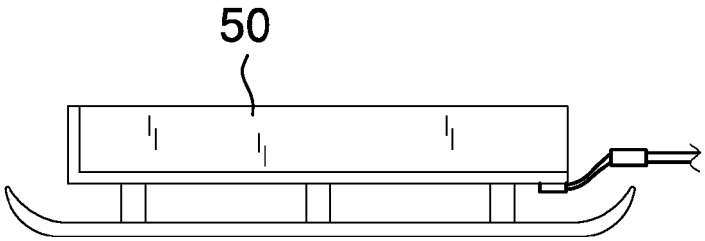
FIG. 10 is a diagrammatic illustration of a transport sled in accordance with an embodiment of the present invention.

In FIG. 10, there is illustrated a side view of an exemplary transport cart 50. Transport cart 50 is configured to receive one or more snow sleds and/or riders thereon for towing up the slope.

Figure 11:
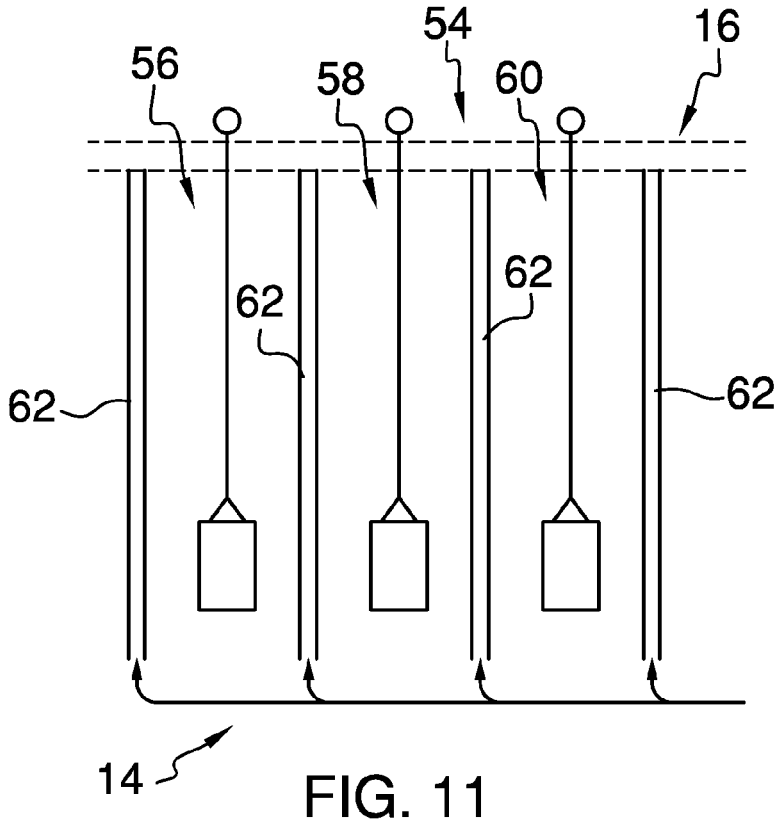
FIG. 11 is a diagrammatic illustration of a snow sled towing device and system in accordance with an embodiment of the present invention.

In FIG. 11, there is diagrammatically illustrated a snow sled towing system 54 for simultaneously and independently towing two or more snow sleds up a slope from a starting position located towards the bottom of the slope to an arriving position located towards a top of the slope. System 54 comprises two or more tow stations 56, 58, 60 arranged side-by-side along the slope and extending between the starting position and the arriving position. Each towing station comprising a separate and complete sled towing assembly as described above with reference to FIGS. 8 through 10. Station 56, 58, 60 are independently operated thereby permitting each station to operate at capacity that is not dependent upon the remaining stations. For example, if one station is shut down, this will not result in the remaining station being shut down.

Figure 12:
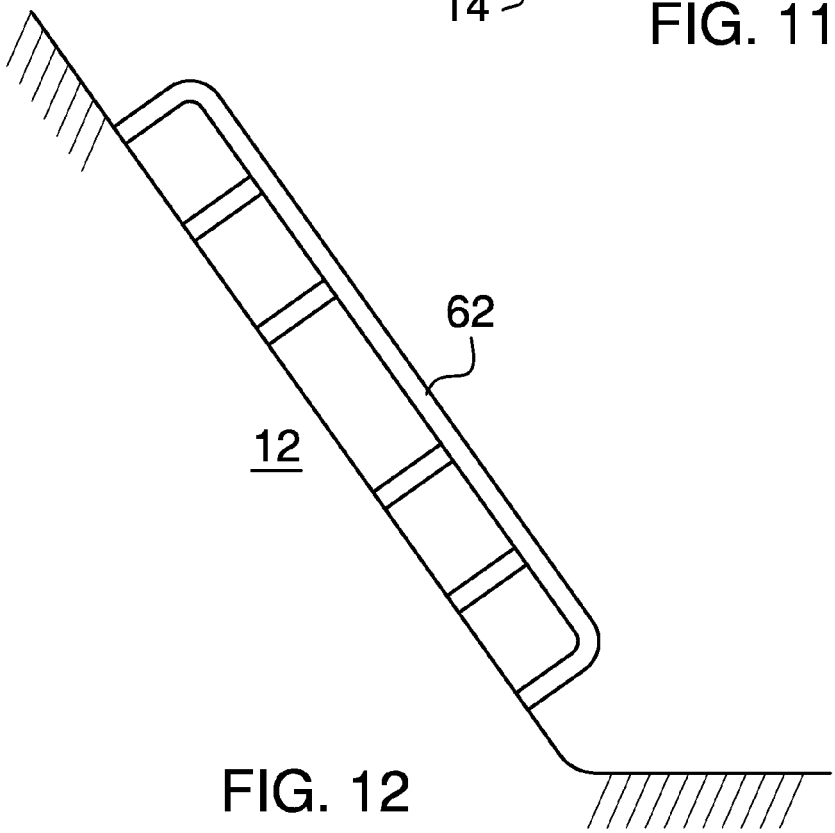
FIG. 12 is a diagrammatic illustration of a guard rail in accordance with an embodiment of the present invention.

As further illustrated, guard rails 62 may be disposed between adjacent stations 56, 58, 60 to separate the stations and prevent collisions between sled being towed in each station. As best depicted in FIG. 12, each guard rail 62 may be comprised of tubular railing anchored to the slope. The tubular railing may be covered in padding to prevent injury to a person making contact with the guard rail.

Figure 13:
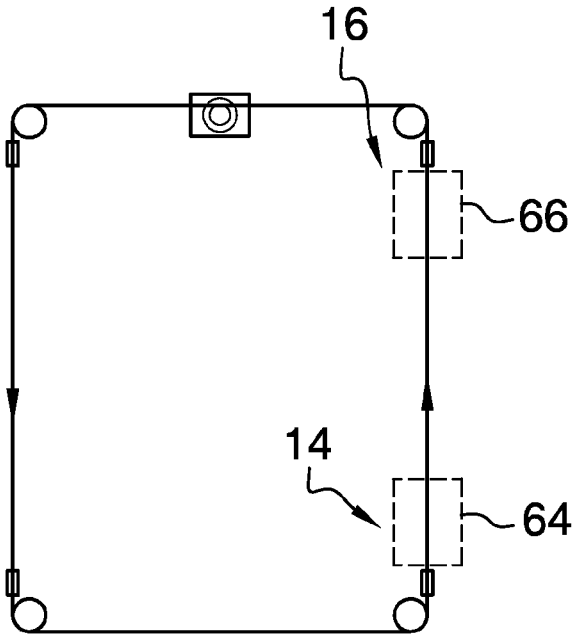
FIG. 13 is a diagrammatic illustration of attendant zones in accordance with an embodiment of the present invention.
Figure 14:
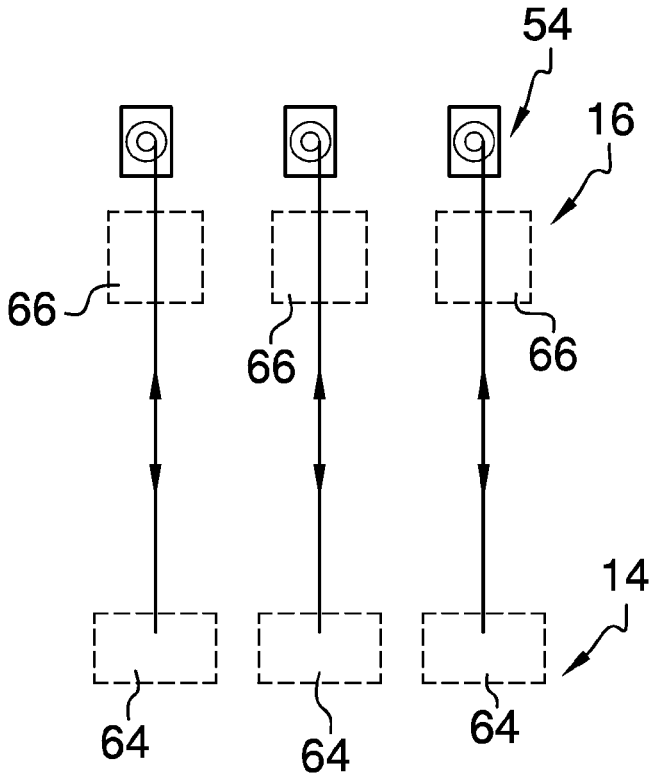
FIG. 14 is a diagrammatic illustration of attendant zones in accordance with an embodiment of the present invention.

In FIGS. 13 and 14, there is diagrammatically illustrated attendant zones 64 at the starting position 14 and attendant zones 66 at the arriving position 16 of the closed loop embodiment of the invention and the system 54 of the invention, respectively.

It is contemplated embodiments of the invention may be permanently constructed and installed on location. Alternatively, embodiments of the invention may be configured for seasonal use and temporarily constructed and installed for use during the sledding season and then removed once the sledding season has ended.

A number of embodiments of the present invention have been described. Nevertheless, it will be understood that various modifications may be made without departing from the spirit and scope of the invention. Accordingly, other embodiments are within the scope of the following claims.

What is claimed is:

1. A snow sled towing device for towing one or more sleds up a slope from a starting position located towards the bottom of the slope to an arriving position located towards a top of the slope the device comprising:

a tow cable extending continuously along a closed loop path between the starting position and the arriving position along the slope;

tow cable pulleys located at the starting position and the arriving position upon which said cable is supported and driven;

a drive motor operatively connected to one of said two cable pulleys and operating to rotatingly drive said pulley to drive said cable through said closed loop path;

one or more tow hooks connected in series at spaced intervals to said tow cable for conjoint movement therewith;

wherein said one or more tow hooks are configured substantially flush with said tow cable; and wherein said tow cable is comprised of multiple lengths that are spliced together by said one or more tow hooks forming said continuous closed loop.

2. The device of claim 1, wherein each of said one or more tow hooks comprising a spring loaded hook member configured to releasably capture a tow rope connected to a sled.

3. The device of claim 2, wherein said drive motor is an electric motor.

4. The device of claim 2, wherein said drive motor is a combustion engine.

5. The device of claim 2, wherein said drive motor is disposed at the arriving position.

6. The device of claim 1, further comprising:

one or more transport sleds secured to a respective tow hook.

7. A snow sled towing device for towing one or more sleds up a slope from a starting position located towards the bottom of the slope to an arriving position located towards a top of the slope, the device comprising:

a tow cable;

a tow cable drum disposed at the arriving position and upon which said tow cable is wound;

a drive motor operatively connected to said tow cable drum and operating to rotationally drive said tow cable drum to wind and unwind said tow cable from said tow cable drum;

one or more tow hooks attached to a free end of said tow cable; and a transport sled secured to said one or more tow hooks.

8. The device of claim 7, wherein said drive motor is an electric motor.

9. The device of claim 7, wherein said drive motor is a combustion engine.

10. A snow sled towing system for simultaneously and independently towing two or more snow sleds up a slope from a starting position located towards the bottom of the slope to an arriving position located towards a top of the slope, the device comprising:

a plurality of tow stations arranged side-by-side along the slope and extending between the starting position and the arriving position;

a guard railing disposed between adjacent tow stations;

wherein each tow station includes a tow cable, a tow cable drum disposed at the arriving position and upon which said tow cable is wound, a drive motor operatively connected to said tow cable drum and operating to rotationally drive said tow cable drum to wind and unwind said tow cable from said tow cable drum, and one or more tow hooks attached to a free end of said tow cable;

wherein the drive motors of each tow station are operated independently of one another; and a transport sled secured to said one or more tow hooks.

* * * * *